US008665170B2

(12) United States Patent
Bishop et al.

(10) Patent No.: US 8,665,170 B2
(45) Date of Patent: Mar. 4, 2014

(54) ANTENNA ASSEMBLY HAVING MULTIPLE ANTENNA ELEMENTS WITH HEMISPHERICAL COVERAGE

(75) Inventors: Bruce Foster Bishop, Aptos, CA (US); Luis Cardenas, Watsonville, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 416 days.

(21) Appl. No.: 12/164,911

(22) Filed: Jun. 30, 2008

(65) Prior Publication Data

US 2009/0322648 A1 Dec. 31, 2009

(51) Int. Cl.
*H01Q 5/01* (2006.01)
*H01Q 21/20* (2006.01)
*H01Q 9/38* (2006.01)

(52) U.S. Cl.
USPC ..... 343/826; 343/828; 343/829; 343/846; 343/872

(58) Field of Classification Search
USPC ..... 343/700 MS, 846, 828, 702, 713, 826, 343/829, 872, 893, 905, 906
See application file for complete search history.

(56) References Cited

U.S. PATENT DOCUMENTS

| | | | | | |
|---|---|---|---|---|---|
| 4,575,725 | A * | 3/1986 | Tresselt | ..... | 343/700 MS |
| 4,907,006 | A * | 3/1990 | Nishikawa et al. | .... | 343/700 MS |
| 5,181,044 | A * | 1/1993 | Matsumoto et al. | ..... | 343/752 |
| 5,355,142 | A * | 10/1994 | Marshall et al. | ..... | 343/700 MS |
| 5,402,136 | A * | 3/1995 | Goto et al. | ..... | 343/729 |
| 6,356,242 | B1 * | 3/2002 | Ploussios | ..... | 343/795 |
| 6,426,723 | B1 | 7/2002 | Smith et al. | | |
| 6,448,933 | B1 | 9/2002 | Hill et al. | | |
| 6,563,468 | B2 * | 5/2003 | Hill et al. | ..... | 343/741 |
| 2002/0140612 | A1 * | 10/2002 | Kadambi et al. | ..... | 343/702 |
| 2008/0062058 | A1 | 3/2008 | Bishop | | |

* cited by examiner

*Primary Examiner* — Michael C Wimer

(57) ABSTRACT

An antenna assembly includes a cable assembly having at least one wire and a circuit board assembly having a ground plane and a plurality of mounting locations. The wire(s) is electrically connected to corresponding mounting locations. A plurality of antenna elements are mounted to the circuit board at corresponding mounting locations. Each antenna element has a feed finger and a ground finger, where the ground finger is electrically connected to the ground plane and the feed finger is electrically connected to the corresponding wire. Each antenna element has a first portion extending from the circuit board along a first plane and a second portion extending from the first portion along a second plane that is transverse to the first plane. Each antenna element provides hemispherical coverage and wide frequency bandwidth.

21 Claims, 8 Drawing Sheets

ANTENNA ASSEMBLY HAVING MULTIPLE ANTENNA ELEMENTS WITH HEMISPHERICAL COVERAGE

BACKGROUND OF THE INVENTION

The subject matter herein relates generally to antenna assemblies, and more particularly, to antenna assemblies having multiple antenna elements with hemispherical coverage.

Wireless communication devices are in wide use today, particularly due to the convenience of enabling wireless access to applications and data. Wireless communication devices typically utilize antenna assemblies to establish a wireless connection with other devices. Typical wireless communication devices include computers, game consoles, cell phones, MP3 players, PDA's and the like, that are coupled to a network such as a wireless local area network (LAN). The LANs are used in the wireless transmission and reception of digitally-formatted data using transceivers operating at least one frequency range, such as 2.4-2.5 GHz., 5.2-5.8 GHz., and others. Antennas are required for the transceivers operating over these frequency bands. Typically, the antennas are designed to operate in a relatively narrow frequency range and thus have a limited bandwidth.

The vast majority of antennas are simple vertical rods a quarter of a wavelength long. Such antennas are simple in construction, usually inexpensive, and both radiate in and receive from all horizontal directions. One limitation of these antenna is that the antenna does not receive in the direction in which the rod points. Reception above and below the antenna is reduced in favor of better reception (and thus range) in other directions.

Prior art wireless communication devices have constantly strived toward improved performance while following the continuing trend toward lower cost, and ever more compact antenna designs. Known antennas are not without disadvantages. For instance, in wireless LAN data transfer operations, loss of signal strength, interruptions in data transfer, and the deleterious effects of signal interference all present potential sources of error and problems with known antennas during data transfer. These problems are exaggerated with antennas that operate in wider frequency ranges.

A need remains for an antenna that can be used in multiple frequency bands. A need remains for an antenna that provides good omnidirectional coverage.

BRIEF DESCRIPTION OF THE INVENTION

In one embodiment, an antenna assembly is provided that includes a cable assembly having at least one wire and a circuit board assembly having a ground plane and a plurality of mounting locations. The wire(s) is electrically connected to corresponding mounting locations. A plurality of antenna elements are mounted to the circuit board at corresponding mounting locations. Each antenna element has a feed finger and a ground finger, where the ground finger is electrically connected to the ground plane and the feed finger is electrically connected to the corresponding wire. Each antenna element has a first portion extending from the circuit board along a first plane and a second portion extending from the first portion along a second plane that is transverse to the first plane. Each antenna element provides hemispherical coverage.

Optionally, each antenna element may be identically formed. The first portion may extend perpendicular to the ground plane and the second portion may extend perpendicular to the first portion. The feed finger and the ground finger may be separated from one another by a slot that has a predetermined length and width to control the impedance of the antenna element. Optionally, three antenna elements may be provided such that each antenna element is positioned equidistant from each other antenna element.

In another embodiment, an antenna assembly is provided that includes a substrate having a plurality of mounting locations and a plurality of antenna elements mounted to the substrate at corresponding mounting locations. Each antenna element has a first portion extending from the substrate along a first plane and a second portion extending from the first portion along a second plane that is orthogonal to the first plane. Each antenna element has a phase center, where the mounting locations are oriented on the substrate such that the phase centers of adjacent antenna elements are equally spaced apart from one another by a spacing distance.

In a further embodiment, an antenna element is provided including a first portion extending along a first plane. The first portion is bounded by an inner edge, an outer edge and opposed first and second end edges. The first portion has a feed finger extending from the outer edge and a ground finger extending from the outer edge. A second portion extends along a second plane that is orthogonal to the first plane, where the second portion is bounded by an inner edge, an outer edge and opposed first and second end edges. The inner edges are joined to one another and define an intersection between the first and second portions. The outer edges are non-linear. Optionally, antenna element may include a longitudinal axis, a first lateral axis and a second lateral axis, where the first portion has a height defined along the first lateral axis and a length defined along the longitudinal axis, and where the second portion has a width defined along the second lateral axis and a length defined along the longitudinal axis.

Optionally, the lengths of the first and second portions may be different. The width of the second portion proximate the first end edge may be greater than the width of the second portion proximate the second end edge. The height of the first portion proximate the first end edge may be greater than the height of the first portion proximate the second end edge. The first portion may define a feed side proximate the first end edge and a ground side proximate the second end edge with the feed finger extending from the feed side and the ground finger extending from the ground side. The surface area of the feed side of the first portion may be greater than the surface area of the ground side of the first portion. The second portion may define a feed side proximate the first end edge and a ground side proximate the second end edge. The surface area of the feed side of the second portion being greater than the surface area of the ground side of the second portion. Optionally, the width of the second portion may be greater than the height of the first portion along the entire length of the first and second portions.

DETAILED DESCRIPTION OF THE INVENTION

Figure 1:
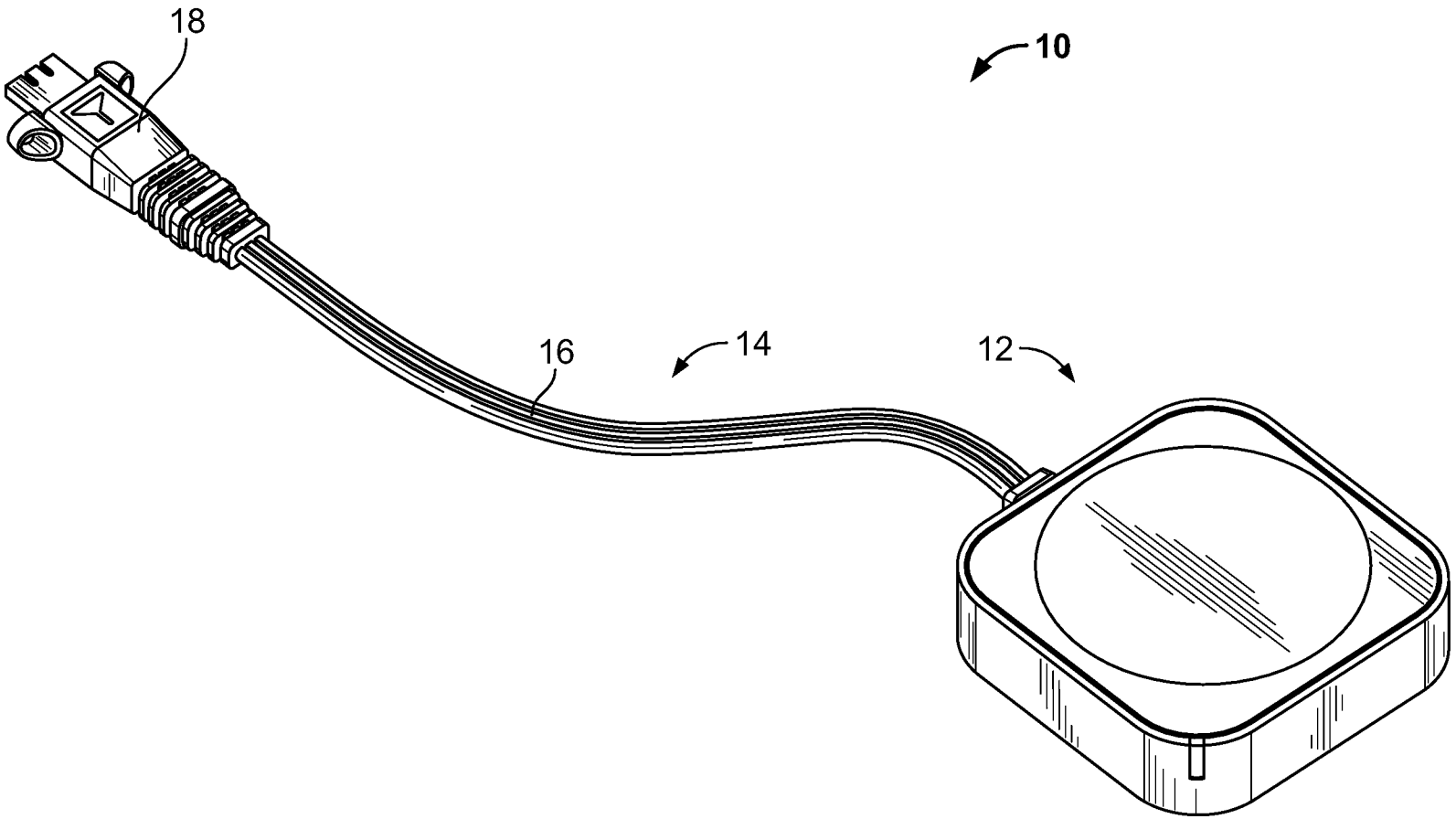
FIG. 1 is a top perspective view of an antenna assembly formed in accordance with an exemplary embodiment.

FIG. 1 is a top perspective view of an antenna assembly 10 formed in accordance with an exemplary embodiment. The antenna assembly 10 includes an antenna housing 12 and a cable assembly 14 extending from the antenna housing 12. The cable assembly 14 includes a cable 16 and a connector 18 at an end of the cable 16. The connector 18 is configured to be connected to a mating connector (not shown) of a device (not shown). In an exemplary embodiment, the device is a wireless communication device, such as a computer, game console, cell phone, MP3 player, PDA, and the like. The device uses the antenna assembly 10 to enable wireless access to applications, data, media and/or streams. In an exemplary embodiment, the antenna assembly 10 is a high isolation multiple in, multiple out (MIMO) antenna assembly.

Figure 2:
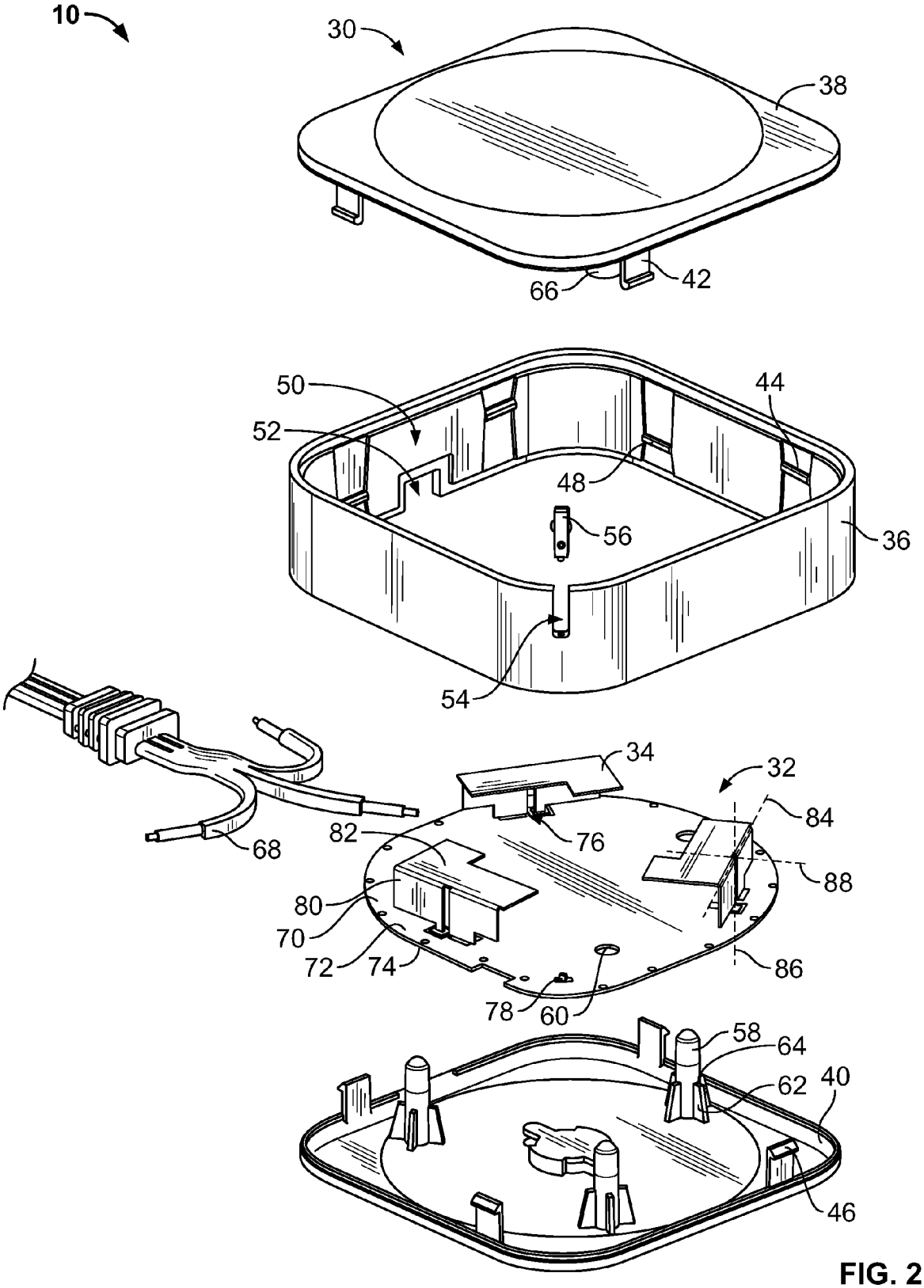
FIG. 2 is an exploded view of the antenna assembly shown in FIG. 1.

FIG. 2 is an exploded view of the antenna assembly 10. The antenna assembly 10 includes a housing 30, a circuit board assembly 32 that is held within the housing 30, and multiple antenna elements 34 mounted to the circuit board assembly 32. In the illustrated embodiment, the housing 30 includes a base housing 36 that forms side walls, and top and bottom covers 38, 40 that are coupled to the base housing 36. The top cover 38 includes a plurality of latches 42 and the base housing 36 includes a plurality of upper catches 44. The latches 42 engage the catches 44 to secure the top cover 38 to the base housing 36. The bottom cover 40 includes a plurality of latches 46 and the base housing 36 includes a plurality of lower catches 48. The latches 46 engage the catches 48 to secure the bottom cover 40 to the base housing 36. Other securing means or elements may be provided to secure the top cover 38 and/or bottom cover 40 to the base housing 36 in alternative embodiments. Optionally, at least one of the top and/or bottom covers 38, 40 may be permanently connected to the base housing 36, such as by being integrally formed with, or hingedly coupled to, the base housing 36.

In an exemplary embodiment, the base housing 36 and covers 38, 40 are generally square shaped with rounded corners. Other shapes are possible in alternative embodiments, examples of which include circular, oval, elliptical, rectangular, triangular, or irregularly shaped. The housing 30 defines a cavity 50 bounded by the base housing 36 and covers 38, 40. The circuit board assembly 32 is received within the cavity 50. In an exemplary embodiment, the base housing 36 includes an opening 52 therethrough that receives the cable assembly 14 such that at least a portion of the cable 16 extends into the cavity 50. The base housing 36 includes a slot 54 that receives a light pipe 56.

The bottom cover 40 includes a plurality of alignment posts 58. The alignment posts 58 extend upward from the bottom cover 40 into the cavity 50. The alignment posts 58 extend through post holes 60 in the circuit board assembly 32 to align the circuit board assembly 32 within the cavity 50. Optionally, the alignment posts 58 may include supports 62 that extend along a portion of the alignment posts 58. The supports 62 include a support surface 64 that supports the circuit board assembly 32. As such, the circuit board assembly 32 may be partially elevated off of the bottom cover 40. Optionally, the top cover 38 may include caps 66 that extend downward from the top cover 38 and fit over the tops of the alignment posts 58. The caps 66 may be used to align the top cover 38 during assembly. Optionally, the caps 66 may engage a surface of the circuit board assembly 32 such that the circuit board assembly 32 is captured between the caps 66 and the supports 62.

In an exemplary embodiment, the cable assembly 14 includes a plurality of wires 68 that are joined together to form, or otherwise extend through, the cable 16. The wires 68 are routed into the cavity 50 where the wires 68 are terminated to the circuit board assembly 32. Optionally, an equal number of wires 68 and antenna elements 34 may be provided such that each wire 68 may be electrically connected to a corresponding antenna element 34. While three wires 68 and antenna elements 34 are illustrated in FIG. 2, any number of wires 68 and/or antenna elements 34 may be provided in alternative embodiments. The number of wires 68 and antenna elements 34 may be different in some embodiments, and a single wire may be connected to more than one antenna element 34 in some embodiments.

The circuit board assembly 32 includes a substrate 70, which in the illustrated embodiment is a circuit board and may be referred to hereinafter as circuit board 70. The circuit board 70 includes an antenna side 72 to which the antenna elements 34 are mounted and a cable side 74 to which the wires 68 are terminated. Optionally, the circuit board 70 may have a ground plane and the antenna elements 34 may be grounded to the ground plane of the circuit board 70. The circuit board 70 includes the post holes 60. In an exemplary embodiment, the circuit board 70 includes a plurality of mounting locations 76. The antenna elements 34 are mounted to the circuit board 70 at a corresponding mounting location 76. In an exemplary embodiment, the circuit board assembly 32 includes a light emitting diode (LED) 78 mounted to the antenna side 72 of the circuit board 70. The LED 78 cooperates with the light pipe 56 and light from the LED 78 is emitted from the housing 30 through the light pipe 56.

In an exemplary embodiment, the antenna elements 34 are substantially identically formed. The antenna elements 34 are adapted to provide hemispherical coverage in directions both radially outward from the base housing 30 and above the top cover 38. Each antenna element 34 includes a first portion 80 extending from the circuit board 70 along a first plane and a second portion 82 extending from the first portion 80 along a second plane that is transverse to the first plane. In an exemplary embodiment, the first portion 80 extends generally perpendicularly from the circuit board 70 and has a generally vertical orientation when the antenna assembly 10 (e.g. the bottom cover 40) is resting on a horizontal surface, such as a desk, a table or a floor of a building in typical applications. The second portion 82 extends generally perpendicularly from the first portion 80 such that the antenna element 34 defines a right angle or orthogonal antenna element. The second portion 82 has a generally horizontal orientation when the antenna assembly 10 is resting on a horizontal surface. In an exemplary embodiment, the antenna elements 34 are stamped from a stock material and formed by bending the antenna element 34 at a bend line defined at the intersection of the first and second portions 80, 82.

The planes that the first and second portions 80, 82 extend along are generally defined by a plurality of axes, such as a longitudinal axis 84, a first lateral axis 86 and/or a second lateral axis 88. For example, the first portion 80 has a height defined along the first lateral axis 86 and a length defined along the longitudinal axis 84. The second portion 82 having a width defined along the second lateral axis 88 and a length defined along the longitudinal axis 84.

Figure 3:
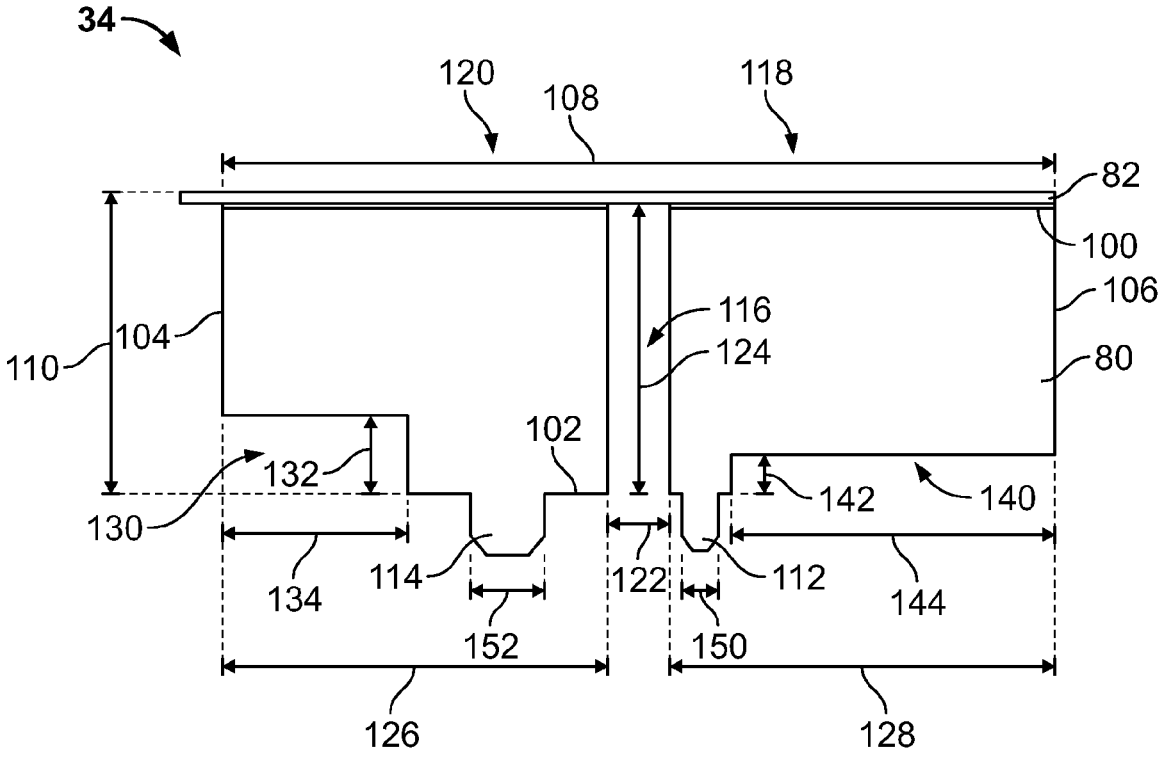
FIG. 3 is a side view of an antenna element for use with the antenna assembly shown in FIG. 1.

FIG. 3 is a side view of one of the antenna elements 34 for use with the antenna assembly 10 (shown in FIG. 1), illustrating the first portion 80 and the second portion 82. The first portion 80 is bounded by an inner edge 100, an outer edge 102 and opposed first and second end edges 104, 106. The first portion 80 has a length 108 defined between the end edges 104, 106. The first portion 80 has a height 110 defined between the inner and outer edges 100, 102.

The first portion 80 includes a feed finger 112 extending from the outer edge 102 and a ground finger 114 extending from the outer edge 102. The feed and ground fingers 112, 114 are configured to be mounted to the circuit board 70 (shown in FIG. 2), as will be described in further detail below. In an exemplary embodiment, a slot 116 is provided in the first portion 80 between the feed finger 112 and the ground finger 114. The slot 116 generally divides the first portion 80 into a feed side 118 and a ground side 120. The feed side 118 extends from the slot 116 to the second end edge 106. The ground side 120 extends from the slot 116 to the first end edge 104. The slot 116 has a length 122 and a height 124 that are selected to control an impedance of the antenna element 34. Optionally, the length 122 and height 124 may be selected to tune the antenna element 34 to have an impedance of approximately 50 Ohms. Optionally, the slot 116 may extend from the outer edge 102 to the inner edge 104 such that the height 124 is substantially equal to the height 110. The slot 116 may be substantially centered between the end edges 104, 106. However, in alternative embodiments, the slot 116 may be positioned closer to either the first end edge 104 or the second end edge 106. In the illustrated embodiment, the slot 116 is positioned a first distance 126 from the first end edge 104 and a second distance 128 from the second end edge 106. In some alternative embodiments, the slot 116 is non-linear and/or may extend non-perpendicularly from the outer edge 102.

The antenna element 34 is designed to receive electromagnetic waves, and is particularly designed and/or dimensioned (e.g. sized and shaped) to operate effectively within selected frequency ranges. In an exemplary embodiment, the antenna element 34 is dimensioned to operate effectively in multiple frequency ranges, examples of which include a first frequency range of between approximately 2 GHz and 3 GHz and at a second frequency range of between approximately 5 GHZ and 6 GHz as well as all frequencies in between. The antenna element 34 may be dimensioned to operate effectively in other frequency ranges as well, including higher frequency ranges, lower frequency ranges, frequency ranges in between the first and second ranges described above and/or frequency ranges within the frequency ranges described above, such as between approximately 2.4 GHz and 2.5 GHz and/or between approximately 5.2 GHZ and 5.8 GHz.

One example of a design characteristic of the antenna element 34 is the type of material used to manufacture the antenna element 34. In an exemplary embodiment, the antenna element 34 is manufactured from a metal material, such as a steel material. Optionally, the material may be a cold rolled steel material. The antenna element 34 may be finished with a coating or plating, such as a tin plating or another type of plating or coating that enhances electrical performance or characteristics. Optionally, the antenna element 34 may be selectively finished in predetermined areas of the antenna element 34.

As described above, another design characteristic of the antenna element 34 is controlling the dimensions, including the size and/or shape, of the antenna element 34. For example, the overall length 108 and/or height 110 of the first portion 80 may be controlled to enhance and/or optimize the performance of the antenna element 34 at a particular frequency or frequencies or at particular range or ranges of frequencies. Additionally, material may be added or removed from particular areas of the first portion 80 to enhance and/or optimize the performance of the antenna element 34 at a particular frequency or frequencies or at a particular range or ranges of frequencies. For example, the ground side 120 may include a cut-out area 130 proximate the first end edge 104 and the outer edge 102. The cut-out area 130 may have a height 132 and a length 134. The cut-out area 130 may be rectangular in shape. The outer edge 102 generally follows the cut-out area 130 from the first end edge 104 to the ground finger 114. In the illustrated embodiment, on the ground side 120, the outer edge 104 is non-linear. The cut-out 130 generally reduces the surface area of the ground side 120 of the first portion 80. Optionally, flaps and/or projections may extend from certain areas of the ground side 120 to change the shape of the ground side 120. The flaps and/or projections may be coplanar with the first portion 80 or may extend at an angle with respect to the first plane.

The feed side 118 may include a cut-out area 140 proximate the second end edge 106 and the outer edge 102. The cut-out area 140 may have a height 142 and a length 144. The height 142 and length 134 may be different than the height 132 and length 134 of the first cut-out 130 such that the cut-outs 130, 140 are sized and or shaped differently. As such, the feed side 118 may exhibit different characteristics than the ground side 120. The cut-out area 140 may be rectangular in shape. The outer edge 102 generally follows the cut-out area 140 from the second end edge 106 to the feed finger 112. In the illustrated embodiment, on the feed side 118, the outer edge 104 is non-linear. The cut-out 140 generally reduces the surface area of the feed side 118 of the first portion 80. Optionally, flaps and/or projections may extend from certain areas of the feed side 118 to change the shape of the feed side 118. The flaps and/or projections may be coplanar with the first portion 80 or may extend at an angle with respect to the first plane.

In an exemplary embodiment, the feed finger 112 and the ground finger 114 project outward from the outer edge 102 and are generally coplanar with the first portion 80. The feed finger 112 has a length 150. The ground finger 114 has a length 152. Optionally, the lengths 150, 152 may be different than one another. For example, in the illustrated embodiment, the length 152 of the ground finger 114 is greater than the length 150 of the feed finger 112. The lengths 150, 152 may be selected to control an electrical characteristic of the antenna element 34. The lengths 150, 152 may be different to provide keying when mounting the antenna element 34 to the circuit board 70 by only allowing the antenna element 34 to be mounted in a certain orientation.

Figure 4:
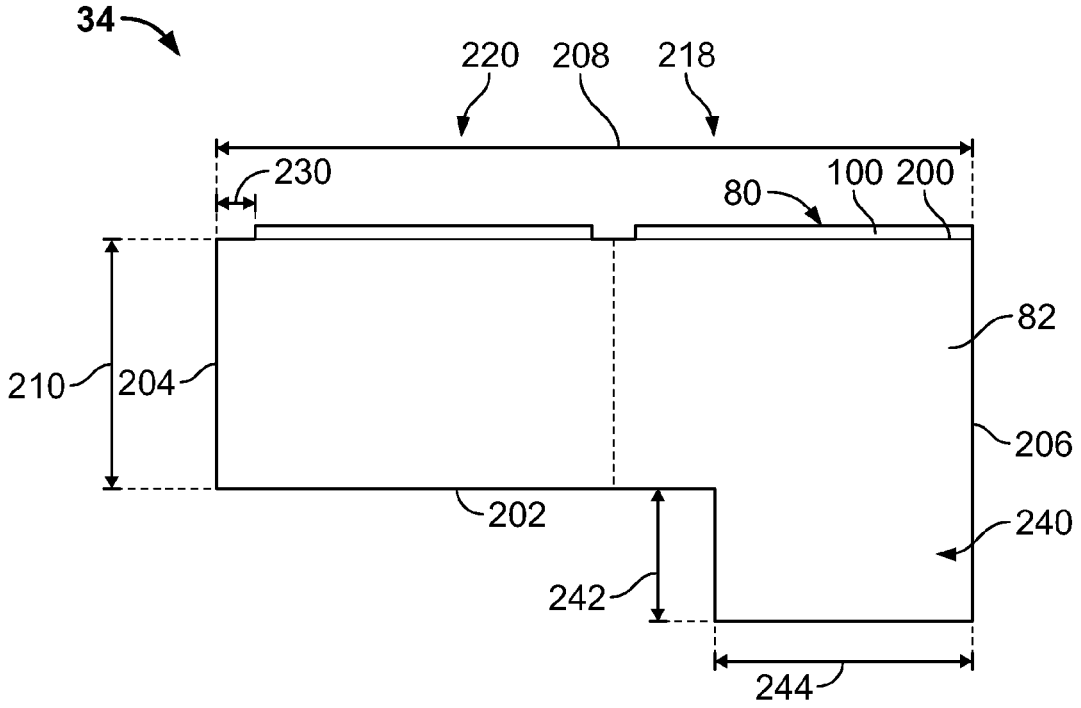
FIG. 4 is a top view of the antenna element shown in FIG. 3.

FIG. 4 is a top view of the antenna element 34, illustrating the second portion 82 and the inner edge 100 of the first portion 80. The second portion 82 is bounded by an inner edge 200, an outer edge 202 and opposed first and second end edges 204, 206. The second portion 82 has a length 208 defined between the end edges 204, 206. The second portion 82 has a width 210 defined between the inner and outer edges 200, 202.

The second portion 82 is integrally formed with the first portion 80 and intersects with the first portion 80 along the inner edges 100, 200 thereof. In an exemplary embodiment, the slot 116 extends to the inner edge 100 and may extend at least partially along the second portion 82. As described above, the slot 116 generally separates the first portion 80 into the feed side 118 and the ground side 220. Similarly, the second portion 82 may be divided into a feed side 218 and a ground side 220. Optionally, the sides 218, 220 may be divided by an imaginary line that is centered on the slot 116. Alternatively, the sides 218, 220 may be defined by something other than the slot, such as a center line between the end edges 204, 206. The feed side 218 extends from inward from the second end edge 206 to the ground side 220. The ground side 220 extends inward from the first end edge 204 to the feed side 218.

As described above, a design characteristic of the antenna element 34 is controlling the dimensions, including the size and/or shape, of the antenna element 34. For example, the overall length 208 and/or width 210 of the second portion 82 may be controlled to enhance and/or optimize the performance of the antenna element 34 at a particular frequency or frequencies or at a particular range or ranges of frequencies. In the illustrated embodiment, the length 208 of the second portion 82 is greater than the length 108 of the first portion 80 such that the second portion 82 extends beyond the first portion 80 by a distance 230. Material may be added or removed from particular areas of the second portion 82 to enhance and/or optimize the performance of the antenna element 34 at a particular frequency or frequencies or at a particular range or ranges of frequencies. For example, the ground side 220 may include a flap and/or projection along the first end edge 204 and/or at least one of the inner edge 200 and the outer edge 202. The ground side 220 may also include a cut-out along the first end edge 204 and/or at least one of the inner edge 200 and the outer edge 202. As such, the first end edge 204 and/or at least one of the inner edge 200 and the outer edge 202 may be non-linear.

In the illustrated embodiment, the feed side 218 includes a flap 240 proximate the second end edge 206 and the outer edge 202. The flap 240 may have a width 242 and a length 244. The flap 240 may be rectangular in shape. The outer edge 202 generally follows the flap 240 from the second end edge 206 to the ground side 220. In the illustrated embodiment, on the feed side 218, the outer edge 204 is non-linear. The flap 240 generally increases the surface area of the feed side 218 of the second portion 82. Optionally, in addition to, or alternatively to, the flap 240, the feed side 218 may include at least one cut-out extending inward from the second end edge 206 and/or the outer edge 202. The cut-out may be provided internally and away from any edge.

Figure 5:
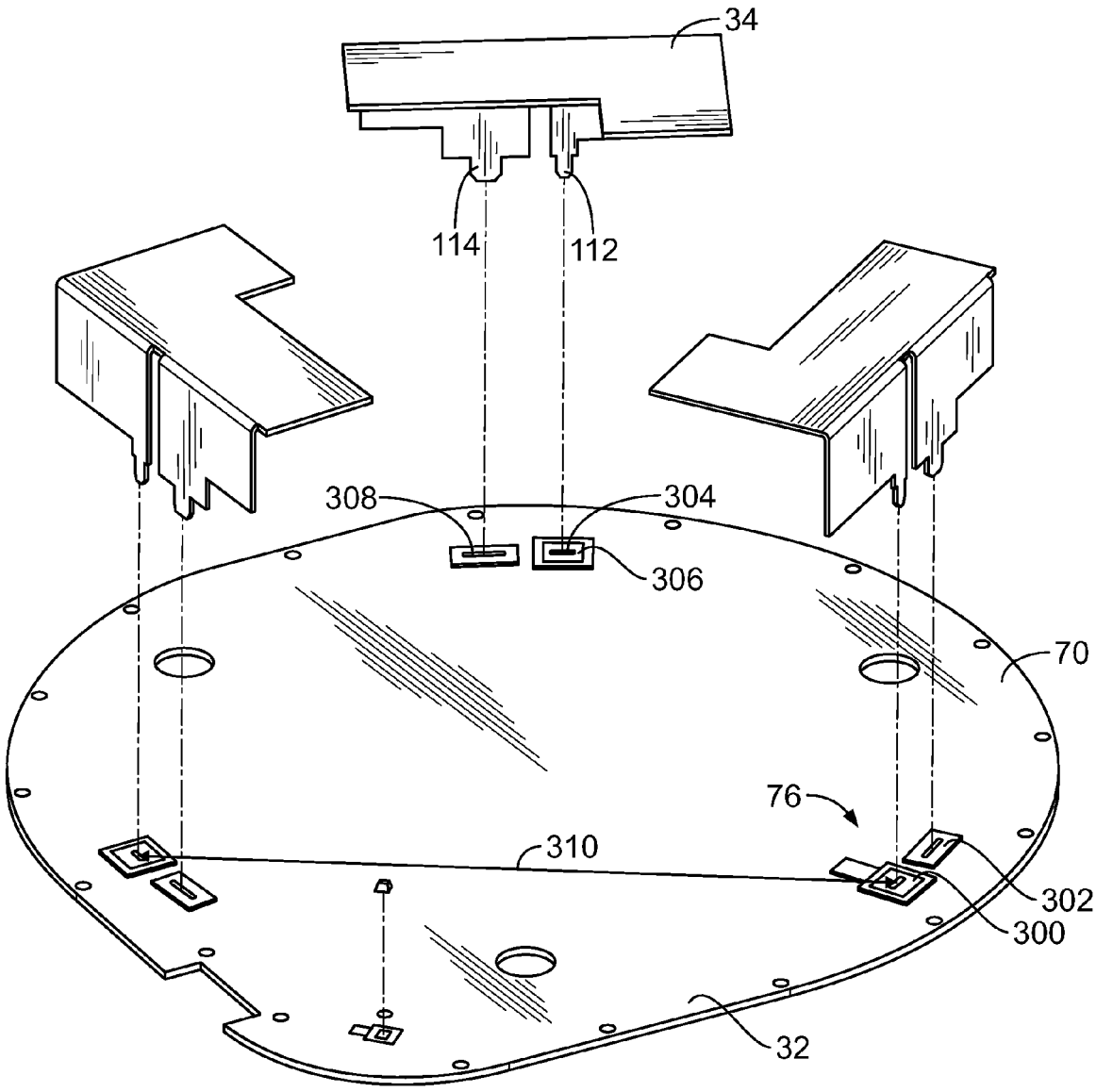
FIG. 5 illustrates a circuit board assembly for the antenna assembly during an assembly step.

FIG. 5 illustrates the circuit board assembly 32 during an assembly step where the antenna elements 34 are mounted to the circuit board 70. As described above, the circuit board 70 includes a plurality of mounting locations 76. In an exemplary embodiment, each mounting location 76 includes a feed pad 300 and a ground pad 302. In an exemplary embodiment, the feed finger 112 and the ground finger 114 are through-hole mounted to the circuit board 70, however, the fingers 112, 114 may be surface mounted or plugged into a connector mounted to the circuit board 70 in alternative embodiments.

In the illustrated embodiment, the feed pad 300 includes a feed via 304 that receives the feed finger 112. The feed finger 112 is electrically connected to the feed pad 300. In an exemplary embodiment, the feed pad 300 is surrounded by an insulator or dielectric element 306 to electrically isolate the feed pad 300 from the ground plane of the circuit board 70. In the illustrated embodiment, the ground pad 302 includes a ground via 308 that receives the ground finger 114. The ground finger 114 is electrically connected to the ground pad 302. The ground pad 302 is electrically connected to the ground plane of the circuit board 70. Optionally, the feed via 304 and the ground via 308 are sized and/or shaped differently to receive the feed finger 112 and the ground finger 114, respectively. For example, the feed via 304 may be sized smaller than the ground finger 114 such that the feed via 304 cannot receive the ground finger 114.

In an exemplary embodiment, the antenna elements 34 are mounted to the circuit board 70 such that the antenna elements 34 are self-supporting. In other words, no additional structure or component is connected to, or between, the antenna element 34 and the circuit board 70 to support the antenna element 34. Rather, the connection between the fingers 112, 114 and the pads 300, 302 secures the antenna elements 34 to the circuit board 70. As such, nothing engages or surrounds any part of the antenna element 34 to potentially interfere with and/or obstruct the reception of the electromagnetic waves. Optionally, the fingers 112, 114 may be soldered to the pads 300, 302 to create a mechanical and/or electrical connection therebetween. The solder may be provided on the cable side 74 of the circuit board 70.

In an exemplary embodiment, each antenna element 34 has a phase center. Optionally, the phase center may be substantially coincident with the feed finger 112. The mounting locations 76 are oriented on the circuit board 70 such that the phase centers of adjacent antenna elements 34 are equally spaced apart from one another by a spacing distance 310. In the illustrated embodiment, three antenna elements 34 are used and the phase centers are oriented at the vertices of an equilateral triangle. As such, each antenna element 34 is positioned equidistant from each other antenna element 34 used. However, in alternative embodiments, more or less antenna elements 34 may be used. In an example having four antenna elements, the antenna elements may be positioned at the vertices of a square such that each antenna element 34 is positioned equidistant from each adjacent antenna element 34. In other alternative embodiments, the antenna elements 34 may not be positioned equidistant from adjacent antenna elements 34.

In an exemplary embodiment, a design characteristic of the antenna element 34 may be controlling the spacing distance 310 between the antenna elements 34. For example, the spacing distance 310 may be selected as a fraction of a particular wavelength of the electromagnetic waves at a particular frequency or frequencies or at a particular range or ranges of frequencies. By way of example only, the antenna assembly 10 may be designed to operate at a first frequency range (e.g. a low frequency range) of between approximately 2.4 GHz and 2.5 GHz and at a second frequency range of between approximately 5.2 GHZ and 5.8 GHz (e.g. a high frequency range). The spacing distance 310 of the phase centers may be selected to better operate in the low frequency range and may be selected such that the spacing distance 310 is less than the wavelength of the low frequency range. Alternatively, or additionally, the spacing distance 310 of the phase centers may be selected to better operate in the high frequency range and may be selected such that the spacing distance 310 is greater than the wavelength of the high frequency range. In an exemplary embodiment, the spacing distance 310 is selected to be at a ratio of approximately 0.5 the wavelength of the first frequency range and at a ratio of approximately 1.2 the wavelength of the second frequency range, however other ratios are possible in alternative embodiments.

Figure 6:
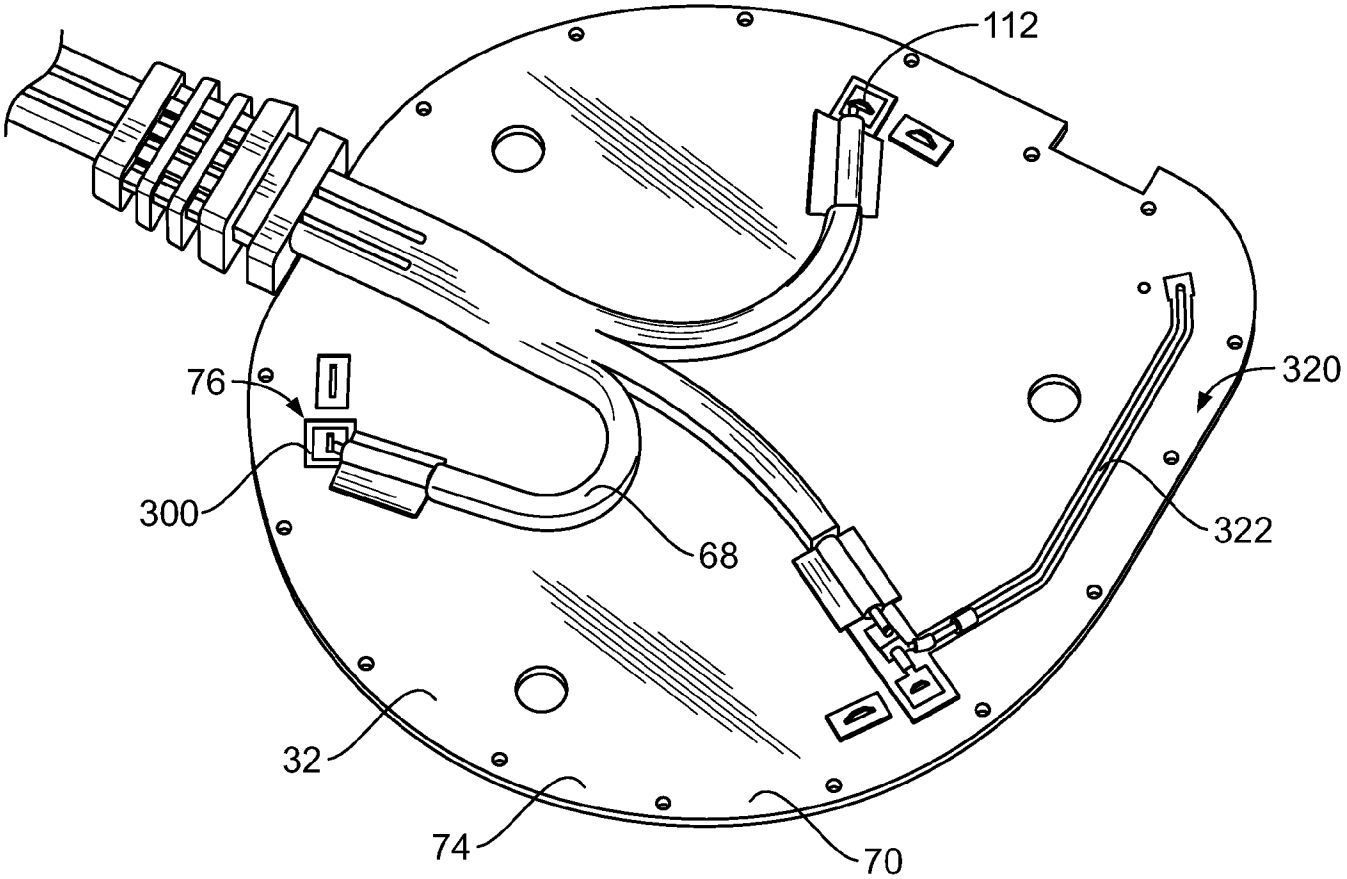
FIG. 6 is a bottom view of the circuit board assembly shown in FIG. 5.

FIG. 6 is a bottom view of the circuit board assembly 32 illustrating the cable side 74 of the circuit board 70. Each of the wires 68 are terminated to a corresponding feed pad 300, and thus electrically connected to a corresponding feed finger 112 of the antenna elements 34 (shown in FIG. 2). The wires 68 are terminated to the feed pads 300 at the mounting locations 76. Optionally, the wires 68 may be terminated directly to the feed finger 112 of the antenna element 34. In an exemplary embodiment, the wires 34 are soldered to the feed pad 300 and/or feed finger 112. In alternative embodiments, the wires 34 may be indirectly connected to the feed pads 300 and/or feed fingers 112, such as by being terminated to solder pads and/or traces remote from the mounting locations 76, and interconnected thereto by traces on the circuit board 70.

In an exemplary embodiment, an LED circuit 320 is provided and is electrically connected to at least one of the wires 68 and/or the feed pads 300. The LED circuit 320 includes a trace 322 routed along the cable side 74 of the circuit board 70 to the area where the LED 78 (shown in FIG. 2) is located. The LED 78 is electrically coupled to the trace 322, such as by a via through the circuit board 70.

An antenna assembly 10 is thus provided that may be operable in multiple frequencies and that provides hemispherical coverage. The antenna assembly 10 includes a plurality of antenna elements 34 that are dimensions, oriented and spaced to provide efficient reception and transmission of electromagnetic waves. The antenna elements 34 have two planar portions 80, 82 that are oriented on different, transverse planes. In an exemplary embodiment, the portions are orthogonal to one another. The antenna elements 34 are spaced equidistant from adjacent antenna elements 34 to provide good isolation and correlation. The spacing distance 310 between the antenna elements 34 is controlled to control the isolation and correlation of the antenna assembly 10, and may be selected as a ratio of the wavelength at a particular frequency or frequencies.

Figure 7:
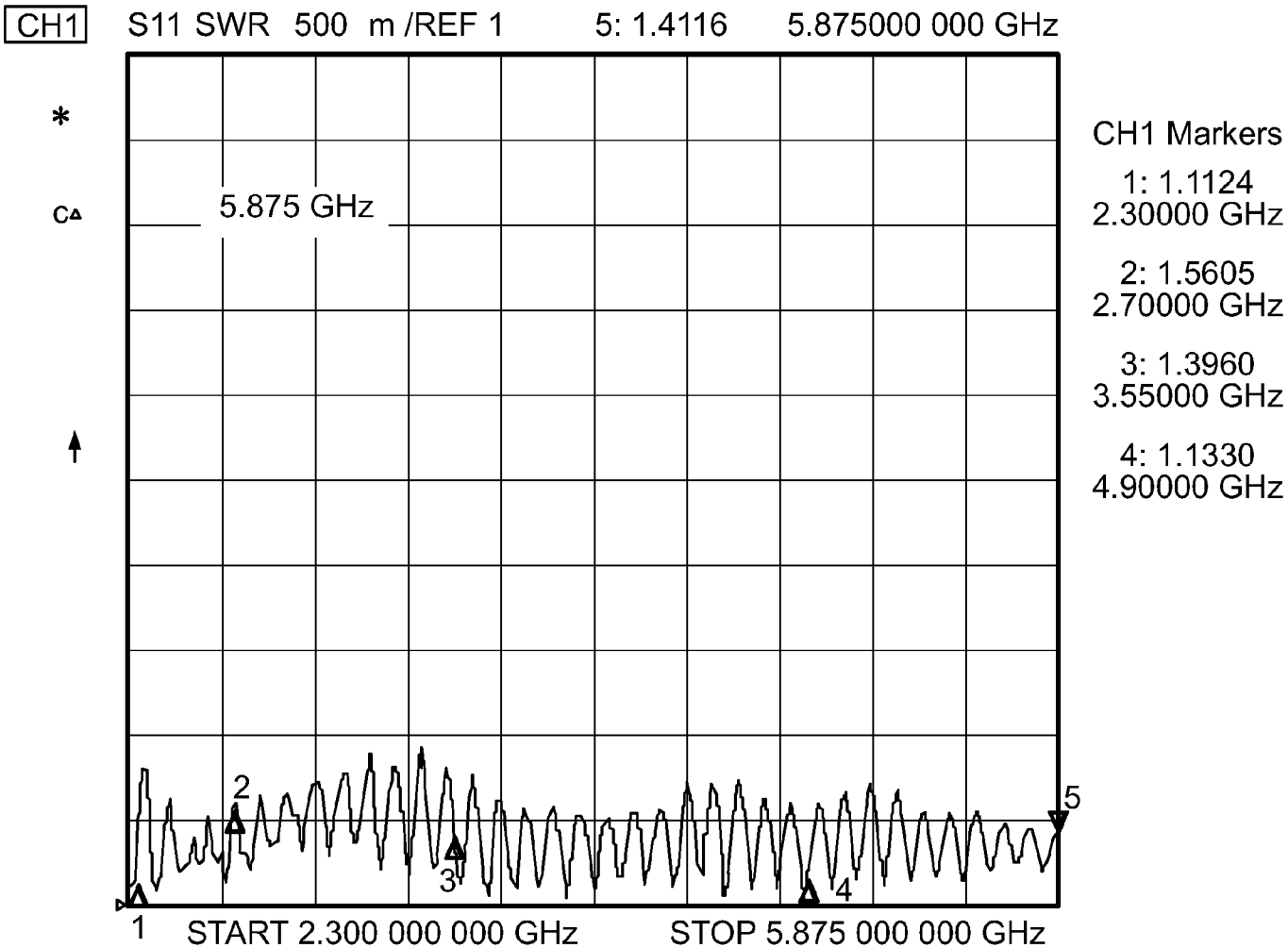
FIG. 7 is a graphical representation of the measured standing wave ratio (SWR), as a function of frequency, of the antenna assembly.
Figure 8:
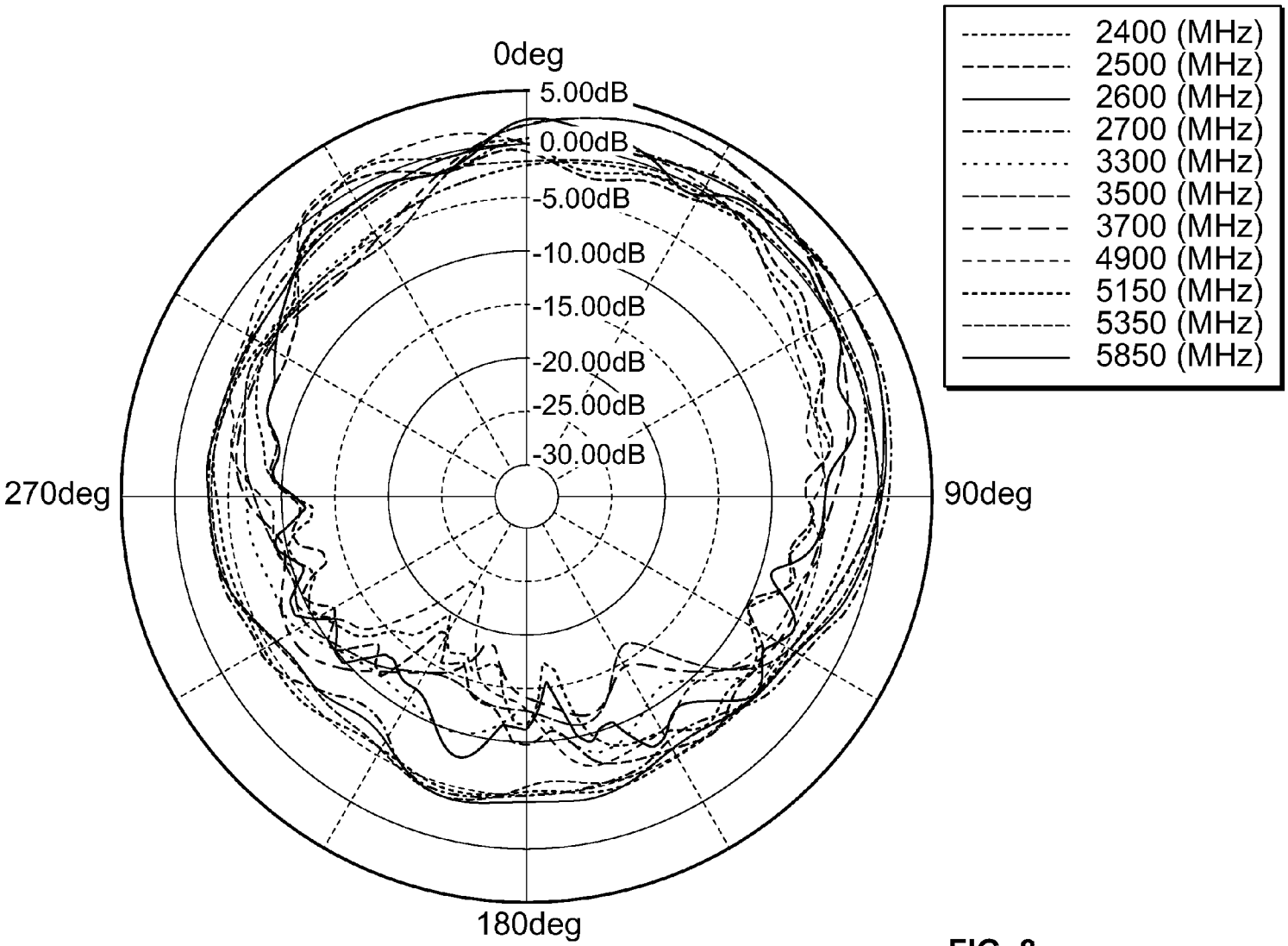
FIG. 8 is a graphical representation of the measured directional pattern, as a function of both frequency and angle, of the antenna assembly.
Figure 9:
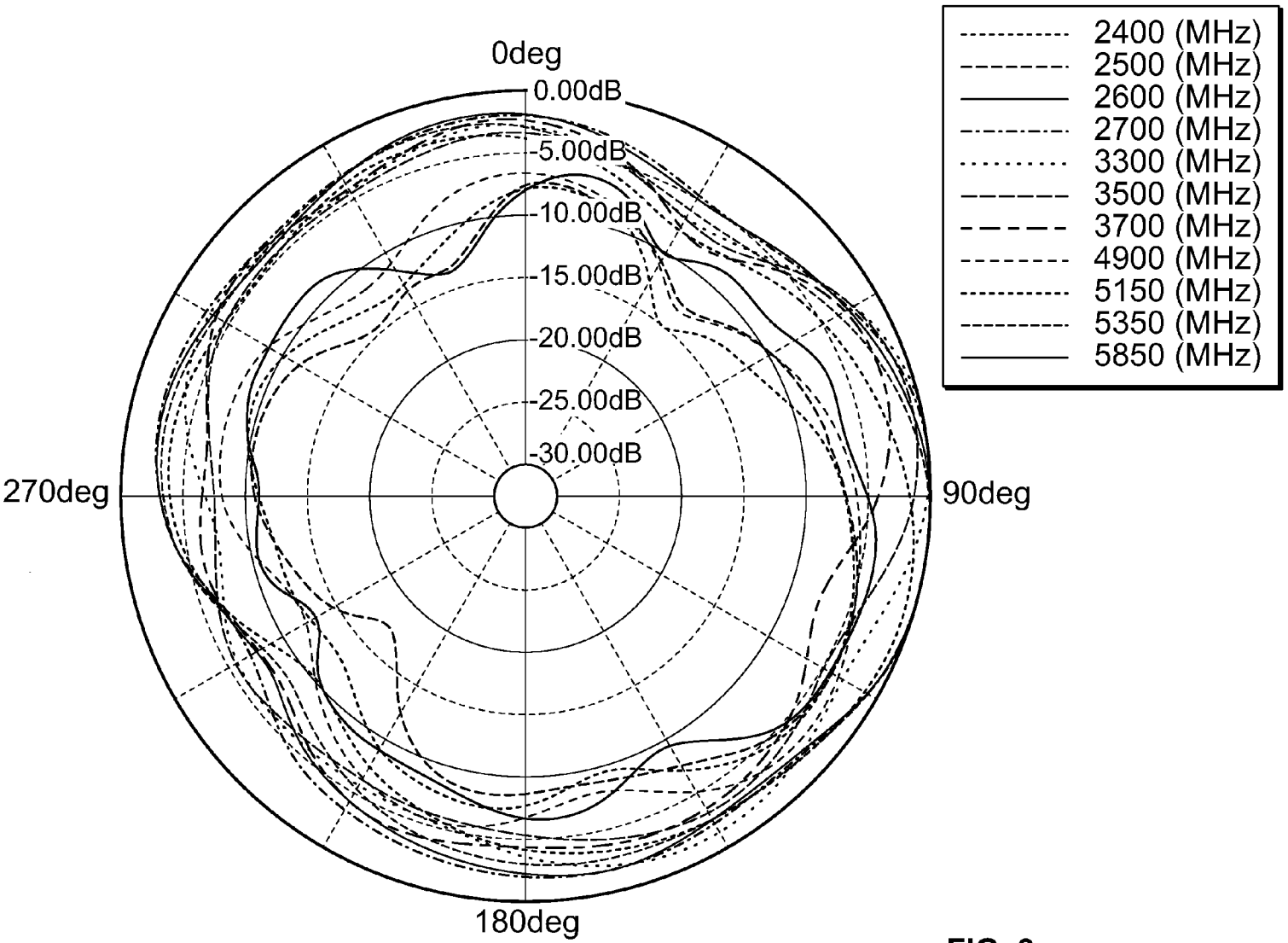
FIG. 9 is a graphical representation of another measured directional pattern, as a function of both frequency and angle, of the antenna assembly.

Such an antenna assembly 10 is particularly useful for WIFI service in the 2.4 GHz or 5 GHz bands, but the antenna assembly 10 is not limited to those frequency ranges. For example, parameters of the antenna elements 34 were measured at ranges from approximately 2 GHz to approximately 6 GHz. FIG. 7 shows the measured standing wave ratio (SWR), as a function of frequency, of the antenna assembly 10. FIG. 8 shows the measured directional pattern, as a function of both frequency and angle (e.g. horizontal), of the antenna assembly 10. FIG. 9 shows another measured directional pattern, as a function of both frequency and angle (e.g. vertical), of the antenna assembly 10.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An antenna assembly comprising:

a cable assembly having at least one wire;

a circuit board assembly having a ground plane as a layer of the circuit board assembly and a plurality of mounting locations with feed vias and ground vias, the ground vias being electrically connected to the ground plane, the circuit board assembly having feed pads, the at least one wire being terminated to corresponding feed pads, the feed pads being electrically connected to corresponding feed vias by conductive traces of the circuit board assembly to electrically connect the at least one wire to corresponding mounting locations; and a plurality of L-shaped antenna elements separately provided from each other and from the circuit board, the antenna elements being mounted to the circuit board at corresponding mounting locations, each antenna element having a feed finger and a ground finger, the ground finger being received in the corresponding ground via and being electrically connected to the ground plane, the feed finger being received in the corresponding feed via and being electrically connected to the corresponding wire by the conductive trace of the circuit board assembly, each L-shaped antenna element having a first portion extending from the circuit board along a first plane and a second portion extending from the first portion along a second plane that is transverse to the first plane, the first and second portions meeting at edges thereof, each antenna element providing hemispherical coverage.

2. The antenna assembly of claim 1, wherein each antenna element is identically formed to define discrete 3-dimensional stamped metal antenna elements with the first portion having both the feed finger and the ground finger mounted to the printed circuit board assembly.

3. The antenna assembly of claim 1, wherein the first portion extends perpendicular to the ground plane and the second portion extends perpendicular to the first portion.

4. The antenna assembly of claim 1, wherein the feed finger and the ground finger are separated from one another by a slot through the corresponding antenna element, the slot having a predetermined length and width to control the impedance of the antenna element.

5. The antenna assembly of claim 1, wherein three antenna elements are provided, each antenna element being positioned equidistant from each other antenna element.

6. The antenna assembly of claim 1, wherein the antenna elements are mounted to the mounting locations in a self-supporting orientation.

7. The antenna assembly of claim 1, wherein the antenna elements are shaped to be operable in at least two frequency ranges with a correlation of less than 0.1.

8. The antenna assembly of claim 1, wherein the feed finger and the ground finger each have mounting tabs through-hole mounted in the corresponding feed via and ground via in the circuit board assembly.

9. The antenna assembly of claim 1, wherein the edge is an exterior edge of the antenna element defining a right angle corner of the antenna element.

10. The antenna assembly of claim 1, wherein each antenna element is a 3-dimensional stamped metal antenna having first and second portions integral and stamped and formed from a common workpiece and having the feed finger and the ground finger integral and stamped and formed from a common work piece.

11. The antenna assembly of claim 1, wherein each antenna element provides hemispherical coverage and wide frequency bandwidth of at least 100%.

12. The antenna assembly of claim 1, wherein the circuit board assembly is a printed circuit board having the ground plane as a printed circuit layer of the circuit board assembly, having the conductive trace printed on one or more layers of the circuit board assembly, having the feed pad printed on one or more layers of the circuit board assembly, and having the ground and feed vias being plated vias extending through the circuit board assembly.

13. An antenna element comprising:

an L-shaped body having a first portion and a second portion integral with the first portion;

the first portion extending along a first plane, the first portion being bounded by an inner edge, an outer edge and opposed first and second end edges, the first portion having a feed finger extending from the outer edge and a ground finger extending from the outer edge; and the second portion extending along a second plane that is orthogonal to the first plane, the second portion being bounded by an inner edge, an outer edge and opposed first and second end edges, wherein the inner edges are joined to one another and define an intersection between the first and second portions at a corner of the L-shaped body, and wherein the outer edges are non-linear.

14. The antenna element of claim 13, wherein the antenna element is stamped from a stock material and formed by bending the antenna element at a bend line defined at the intersection of the first and second portions.

15. The antenna element of claim 13, wherein the first portion includes a slot extending at least partially between the outer edge and the inner edge, the feed finger positioned on one side of the slot, the ground finger positioned on the other side of the slot.

16. The antenna element of claim 13, further comprising a longitudinal axis, a first lateral axis and a second lateral axis, the first portion having a height defined along the first lateral axis and a length defined along the longitudinal axis, the second portion having a width defined along the second lateral axis and a length defined along the longitudinal axis.

17. The antenna element of claim 16, wherein the lengths of the first and second portions are different.

18. The antenna element of claim 16, wherein the width of the second portion proximate the first end edge is greater than the width of the second portion proximate the second end edge.

19. The antenna element of claim 16, wherein the height of the first portion proximate the first end edge is greater than the height of the first portion proximate the second end edge.

20. The antenna element of claim 16, wherein the first portion defines a feed side proximate the first end edge and a ground side proximate the second end edge with the feed finger extending from the feed side and the ground finger extending from the ground side, the surface area of the feed side of the first portion being greater than the surface area of the ground side of the first portion, and wherein the second portion defines a feed side proximate the first end edge and a ground side proximate the second end edge, the surface area of the feed side of the second portion being greater than the surface area of the ground side of the second portion.

21. The antenna element of claim 16, wherein the width of the second portion is greater than the height of the first portion along the entire length of the first and second portions.

* * * * *